United States Patent [19]

Muller

[11] Patent Number: 4,703,604

[45] Date of Patent: Nov. 3, 1987

[54] EXTERNALLY INSULATED AND SHEATHED MASONRY CONSTRUCTION

[76] Inventor: Robert Muller, 15, boulevard due Fier, 74000 Annecy, France

[21] Appl. No.: 872,103

[22] Filed: Jun. 6, 1986

[30] Foreign Application Priority Data

Jun. 7, 1985 [FR] France ..... 85 09108

[51] Int. Cl.[4] ..... E04B 1/00

[52] U.S. Cl. ..... 52/741; 52/512; 52/508; 52/235

[58] Field of Search ..... 52/741, 127.2, 235, 52/236.7, 264, 266, 267, 283, 351, 353, 577, 701, 702, 747, 508, 512, 506

[56] References Cited

U.S. PATENT DOCUMENTS 4,194,333 3/1980 Paton et al. ..... 52/235

4,425,745 1/1984 Grätz et al. ..... 52/235

FOREIGN PATENT DOCUMENTS 1659558 9/1977 Fed. Rep. of Germany ..... 52/508

*Primary Examiner*—Carl D. Friedman

*Assistant Examiner*—Naoko N. Slack

*Attorney, Agent, or Firm*—Karl F. Ross; Herbert Dubno; Andrew Wilford

[57] ABSTRACT

A method of building a structure formed of a masonry wall having an outer face carrying frame members and insulation and provided with sheathing overlying the frame members and insulation entails generally simultaneously erecting the masonry wall, frame members, and insulation and thereafter applying the sheathing. More particularly first a framework of frame members is erected against an outer brace panel, insulation is fitted between the frame members and against the brace panel, and anchors are fixed to the insulation and framework with stems of the anchors projecting inward away from the panel past the insulation. Then a masonry interior wall either of cast reinforced concrete or block is built against the insulation with the anchors imbedded in the masonry wall. The outer brace panel is then removed and sheathing is secured to the frame members. Thus the exterior walls of the building can be virtually completed, all but the sheathing, one floor at a time. The masonry wall is built after the framework and insulation are set up, working from inside, so that the use of heavy-duty scaffolding and the like is unnecessary.

16 Claims, 15 Drawing Figures

FIG. 3
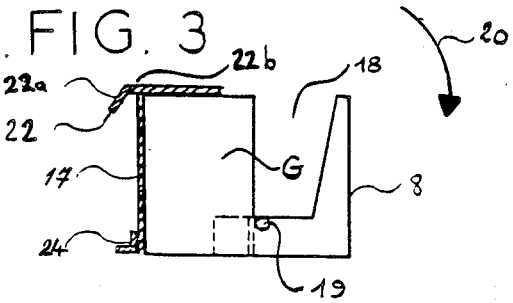
FIG. 4
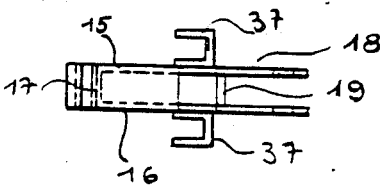
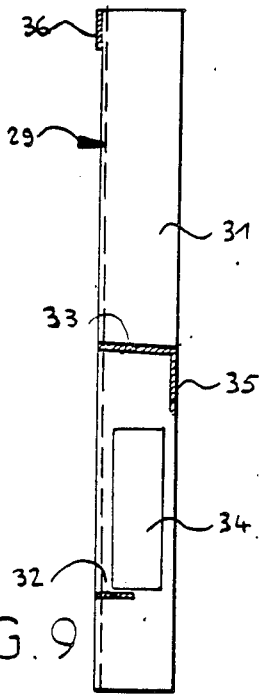
FIG. 9
FIG. 10
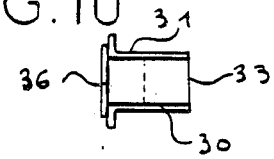
FIG. 5
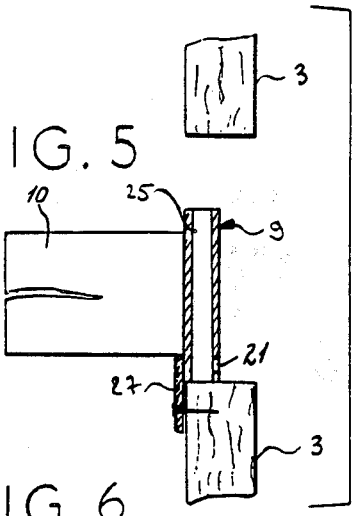
FIG. 6
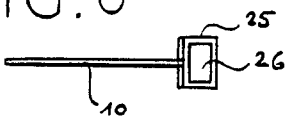
FIG. 7
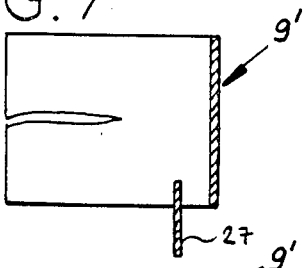
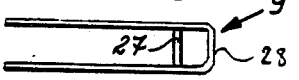
FIG. 8

EXTERNALLY INSULATED AND SHEATHED MASONRY CONSTRUCTION

FIELD OF THE INVENTION

The present invention relates to the construction of an externally insulated and sheathed masonry structure. More particularly this invention concerns a method of and system for erecting a building comprising a masonry interior wall and an exterior structure formed of insulation, frame members, and sheathing.

BACKGROUND OF THE INVENTION

A common form of building has an interior wall of masonry construction, either poured concrete or block, and an exterior wall formed of a plurality of frame members secured to the masonry interior wall, insulation between the frame members, and sheathing overlying the insulation and frame members and secured to the latter. Typically the masonry wall is built up at least part way with the aid of inside and outside forms, and then the outer form is stripped and the frame members are secured to the outer wall surface, the insulation fitted between these members, and the sheathing secured to the frame members over the insulation.

Such style of construction therefore requires that substantial scaffolding be employed for the construction of the outer wall. Thus for a poured wall the outer form is constructed inside this scaffolding and is removed before the outer wall elements are mounted on the masonry inner wall. For a very tall building the scaffolding does not stand on the ground, but is suspended from the top of the wall or from brackets removably secured to the masonry.

The main disadvantage of this style of construction is that the assembly of the outer wall is particularly onerous. The scaffolding normally makes it fairly difficult to work on the masonry wall. Putting together the insulation, frame members, and so on through the scaffolding requires substantial time. The complexity of the job is increased by the fact that the scaffolding must be substantial enough to allow a substantial number of workers to handle and apply a large volume of materials. Thus the construction job is also fairly dangerous because much of the work must be done from scaffolding outside the structure going up.

OBJECTS OF THE INVENTION

It is therefore an object of the present invention to provide an improved method of building an externally insulated masonry structure.

Another object is the provision of such a method of building an externally insulated masonry wall structure which overcomes the above-given disadvantages, that is which can be done rapidly and in a simple manner.

A further object is to provide a system of tools and devices for carrying out this method so that an externally insulated and sheathed masonry wall can be built in a safe and efficient manner.

SUMMARY OF THE INVENTION

A method of building a structure formed of a masonry wall having an outer face carrying frame members and insulation and provided with sheathing overlying the frame members and insulation according to the invention entails generally simultaneously erecting the masonry wall, frame members, and insulation and thereafter applying the sheathing. More particularly first a framework of frame members is erected against an outer brace panel, insulation is fitted between the frame members and against the brace panel, and anchors are fixed to the insulation and framework with stems of the anchors projecting inward away from the panel past the insulation. Then a masonry interior wall is built against the insulation with the anchors imbedded in the masonry wall. The outer brace panel is then removed and sheathing is secured to the frame members.

Thus with this invention the exterior walls of the building can be virtually completed, all but the sheathing, one floor at a time. The masonry wall is built after the framework and insulation are set up, working from inside, so that the use of heavy-duty scaffolding and the like is unnecessary.

According to this invention the interior wall can be formed of blocks and the anchors have legs secured in the joints between the blocks. It can also be cast of concrete, in which case it is necessary to erect an interior form spaced inward of the insulation. With the latter system the assembly of insulation, framework, and outer brace panel form the outer wall form.

In accordance with another feature of this invention sockets having anchor stems projecting inward past the insulation are secured to the framework and a work platform is suspended from the sockets. Sheathing is done from atop the work platform. More particularly removable brackets are hung from the sockets and the platform is suspended from the sockets by hanging it on the brackets. This sheathing is carried out in stages and the work platform is lowered between successive stages. Thus everything but the sheathing is completed working upward and the sheathing is installed from the top down. Thus the brace panel is supported on the work platform.

According to this invention the framework is formed by vertical frame members and the sockets are mounted between vertically aligned such frame members.

The apparatus of this invention has sockets each comprising an anchor stem adapted to be imbedded in masonry, a socket body having an upwardly open recess, and a mounting tab adapted to be secured to the framework. Each bracket comprises a downwardly projecting tab engageable in the recess of the respective socket body. Furthermore, each socket body is further formed below the upwardly open recess with an outwardly open recess and each bracket has an inwardly projecting tab engageable in the outwardly open recess when the downwardly projecting tab is engaged in the respective upwardly open recess.

A reusable jig is used to vertically space the frame members for mounting therebetween of the sockets. This jig has a downwardly open recess adapted to fit over the upper end of a frame member and an upwardly open recess into which the lower end of another frame member is adapted to fit. The two recesses are vertically offset and the jig is horizontally inwardly open therebetween for insertion of the respective socket.

Each anchor according to this invention includes an anchor stem adapted to be imbedded in the masonry wall and a fixation tab adapted to be secured to the insulation. In addition the work platform has cables attachable to the brackets to suspend the platform therefrom and rigid rails engageable with the brackets to guide the work platform thereon. Hooks for holding the platform on the brackets while the cable is moved down are also provided.

The insulation according to this invention forms vertical passages and the framework includes horizontally offset upper and lower frame members and clips for positioning the upper and lower frame members of vertically adjacent panels such that same overlap. Blocking devices are provided that are engageable in the passage with the insulation for bracing same during building of the wall.

The anchors can be fixed from outside to the framework and they can be vertically adjustable for use with a block interior wall.

DESCRIPTION OF THE DRAWING

The above and other features and advantages will become more readily apparent from the following, it being understood that any feature described with reference to one embodiment of the invention can be used where possible with any other embodiment. In the accompanying drawing:

FIG. 3 is a vertical section through a support bracket according to this invention;

FIG. 4 is a top view of the bracket of FIG. 3;

FIG. 5 is a vertical section through a socket for the bracket of this invention with some of the associated wall structure;

FIG. 6 is a top view of the socket of FIG. 7;

FIGS. 7 and 8 are vertical sectional and top views, like FIGS. 3 and 4, through another socket according to the invention;

FIG. 9 is a vertical section through an assembly jig according to this invention;

FIG. 10 is a top view of the jig of FIG. 9;

SPECIFIC DESCRIPTION

Figure 1:
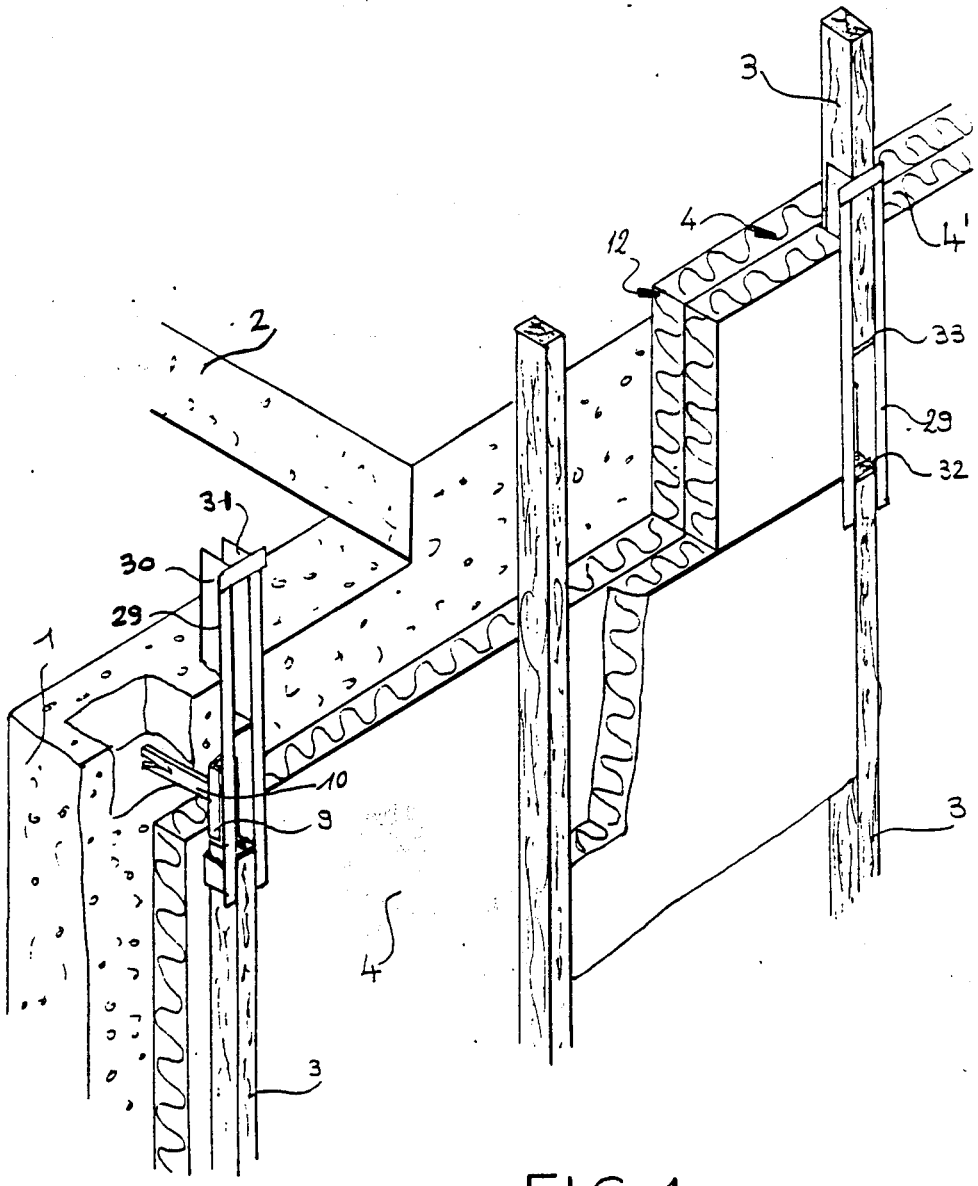
FIG. 1 is is a partly broken away and sectional view illustrating the construction of a building according to this invention.
Figure 2:
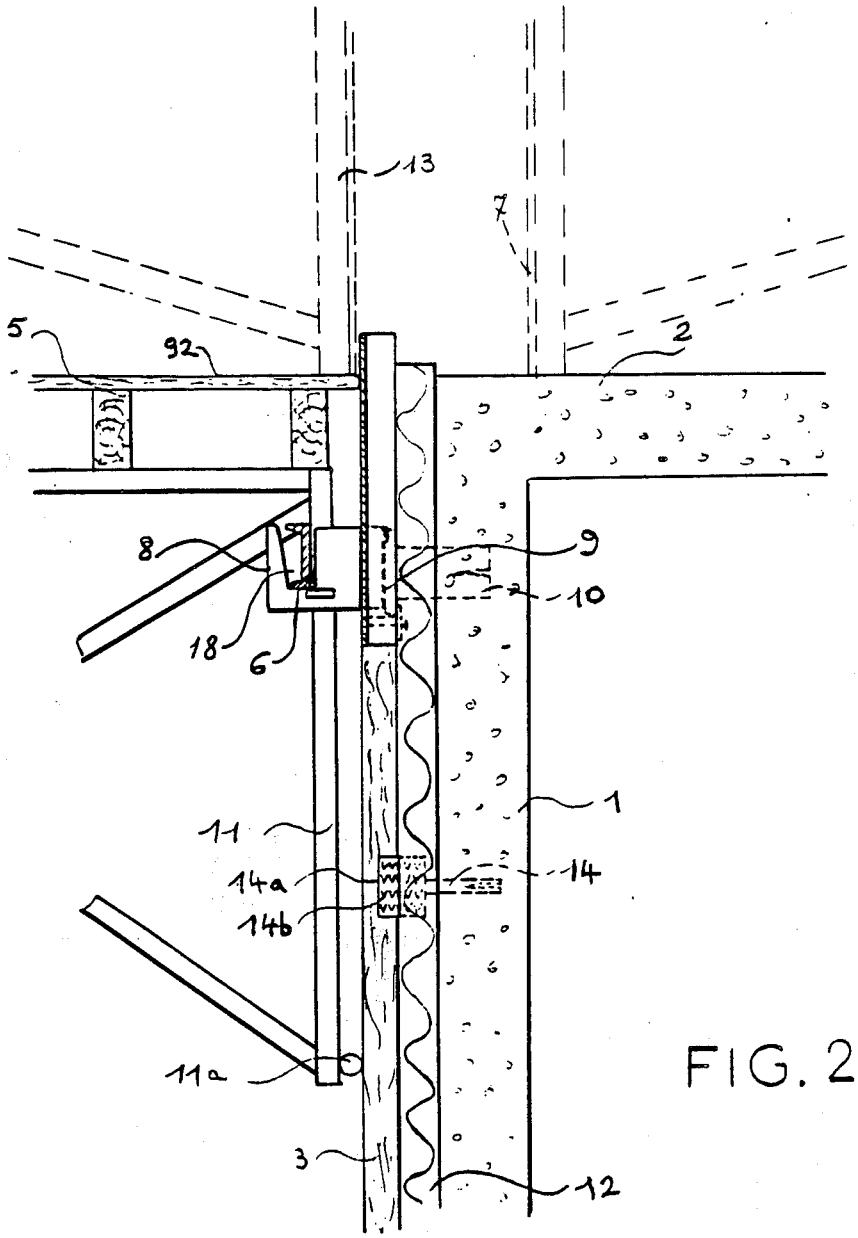
FIG. 2 is a vertical section showing another detail of the building-construction method and system.

As seen in FIGS. 1 and 2 a wall structure according to this invention comprises a masonry inner wall 1, here of reinforced concrete that is integral with a floor slab 2, and an outer wall formed of frame members 3 and insulation 12. As shown the members 3 are vertical wooden studs or furring strips 3 typically 2×3's or 2×4's, and the insulation 12 is formed by large panels 4 lying between the edgewise studs 3 and the wall slab 1 and smaller panels 4' between these studs 4. Sheathing (shown at 61 in FIG. 14) is eventually secured to the studs 3 over the insulation 12, for instance by nailing. The studs 3 are secured at a fixed spacing on center, for instance 60 cm, to the inner wall 1 by anchors 14 having plates **14*a* formed with barbs 14*b* that are driven into the sides of the studs 3 and of the insulation 12**.

The wall also is provided with upwardly open holders or sockets 9 having anchor stems 10 cast into the concrete wall 1 and positioned at every other stud 3 in gaps between vertically adjacent studs 3. These sockets 9 are permanently fixed in the wall just below the floor slabs 2 but are covered by the sheathing when the wall is completed. As seen in FIGS. 5 and 6 such sockets 9 are formed of a square-section tube 25 from which the anchor stem 10 projects and have upwardly open upper ends 26. A mounting tab 27 projects from the bottom of the tube 25 so that the socket 9 can be nailed to the inside face of the top of its stud 3 to hold it accurately in place before the wall 1 is poured.

According to this invention brackets 8 can be hung from the sockets 9 to support a work platform 5 on the outside of the wall. More particularly as seen in FIGS. 3 and 4 each such bracket 8 is formed as an upwardly open hook having an upwardly open mouth 18 and a U-section body formed by two flanges 15 and 16 joined by a bight 17. A plate 22 has a downwardly hooked portion **22*a* engageable in the upper end 26 of the tube 25 of the socket 9 and a flat horizontal part 22*b* welded atop the two webs 15 and 16. Another angle iron 24 is provided at the bottom of the web 17 to engage in a hole 21 formed adjacent the lower end of the tube 25. In addition the hook has a transverse pin 19 and is provided on its flanges 15 and 16 with normally inwardly open and vertical channels 37 whose functions are described in more detail below. This bracket 8 has a center of gravity at G inward of and above the pin 19**.

In use at least two brackets 8 are hooked to respective sockets 9 at the same level. The sockets 9 are slightly below each floor slab 2 on every other line of studs 3, so that they are 120 cm on center. The bracket 8 is normally mounted in place by attaching a line to the pin 19 and lifting it, which will cause it to hang with the tab **22*a* lowermost. This tab 22*a* is dropped into the top end 26 of the tube 25 of the socket 9 to which the bracket 8 is to be secured, and the entire bracket is lowered so it pivots down as shown by arrow 20 until the angle iron or locator finger 24 engages in the hole 21. This leaves the bracket 8 hanging on the socket 9 with its mouth 18 open upward. Removal is only possible by pivoting against the direction of arrow 20; straight upward lifting will be impeded by the finger 24. Such removal can easily be done from above by pulling up a line attached to the crossbar 19, so that a bracket 9** can be removed easily and with no danger to workers underneath.

The work platform 5 has vertical support elements 11 whose lower ends are joined by a horizontal element **11*a* that normally bears inward against several studs 3, and a strong channel 6 that is fixed to the elements 11 and that fits in the mouths 18 of several brackets 8 at the same level. Thus the platform 5 is solidly hung on the wall 1 and defines a horizontal work platform 92 level with the floor slab 2**.

Construction of the wall is facilitated by jigs 29 shown in FIGS. 9 and 10. Such a jig 29 has a pair of parallel angle irons 30 and 31 secured together at the outer faces of their upper ends by a strap 36 and has transverse horizontal webs 32 and 33, the latter being fairly central and having a vertical flange 35. The spacing between the angle irons 30 and 31 is slightly more than the width of the studs, and they are as deep as the studs 3. Thus the jig 29 can be fitted over the top of one stud 3 so that same comes up to abut under the lower web 32 and another stud 33 can be slipped down behind the strap 36 to sit atop the middle web 33. This sets a gap between vertically adjacent studs 3. The jigs 29 are left in place until after the pour, whereupon they are easily pulled out, although if the studs 3 are secured for pouring to the panel 13 the jigs 29 can be removed as soon as this temporary securing is done. Holes 34 in the angle irons 30 and 31 allow the lower web 32 to be nailed to the top of the lower stud 3.

The wall according to this invention is built up from the condition shown in FIG. 2, in which it is is important that the studs 3 and insulation 12 project somewhat above the top of the slab 2, by fixing a vertical outside form or brace panel 13 atop the platform 4 which is hung from the brackets 8. Then jigs 29 are mounted atop every other stud 3, and more studs are fitted atop the existing ones, so that gaps are left where the jigs 29 are. At these gaps the sockets 9 are secured with their stems 10 projecting inward. In addition the plates 14*a* of the anchors 14 are secured to the studs 3 with their stems 14 projecting inward also. The outer panels 4*a* of insulation are then fitted between adjacent rows of studs 3, thereby accurately spacing them, and the inner panels 4 are placed over the inner surfaces of the studs 3 and panels 4', with the stems 10 and 14 poking through these panels 4. The studs 3 can be held at their exact spacing by securing them to the panel 13 or a horizontal spacer can be provided at their upper ends to hold them during assembly and pouring.

All of this work is done from inside the structure, that is from atop the new slab 2 and not from outside atop the platform 5. This makes it possible to do all this work with relative ease and with great safety. Since the studs 3 and insulation 12 are built up from the outside in against the brace panel 13, perfect planarity of the outside wall surface to which the sheathing 61 will later be attached is insured.

Once all the structure described above is assembled, the inside form indicated schematically at 7 is set up, and the next wall 1 and slab 2 are poured. Forms for any openings through the wall are of course set in place before such pour. The insulation 12 is of polystyrene or the like so it is rigid enough to hold back the concrete, and the stems 10 and 14 can be counted on to be very solidly imbedded in the new concrete.

After the new concrete is cured, the outer brace wall 13 is moved out of the way, more brackets 8 are hung at the next level up on the newly installed sockets 9, and the platform 5 is raised up and hung at this next level of brackets. The old brackets 8 are normally then pulled out. In fact the platform 5 can be pulled up off the brackets 8 and the same brackets can be fitted into the next up set of sockets 9 if desired, or the brackets 8 can all be left in until the outer sheathing is installed.

Figure 11:
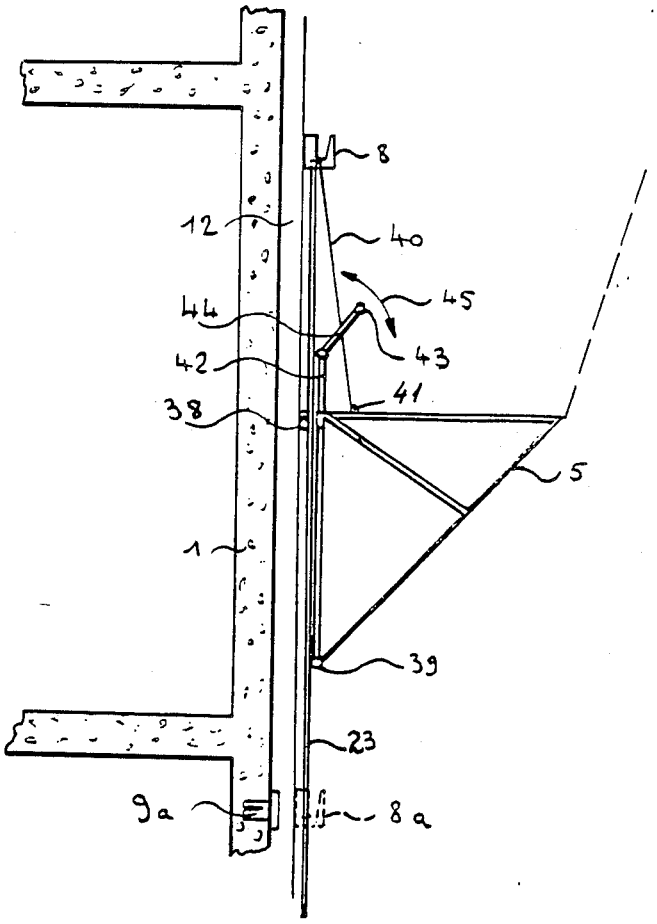
FIG. 11 is a side view partly in vertical section showing more of the construction system and method of this invention.

Once the structure is topped off the platform 5 can be lowered back down one floor at a time while workers on it secure the sheathing 61 in place. This is done as indicated in FIG. 11 by providing the platform 5 with an inner crosspiece 38 and an outer crosspiece 39, and by fitting rods 23 into the inwardly open channels 37 (See FIG. 4.) of the bracket 8 immediately above the platform. Cables 40 attached to the platform 5 pass over the brackets 8 and are secured at winches or the like indicated at 41 to allow the platform to be lowered.

In addition at each bracket row the platform 5 has a mount 42 carrying a pair of arms 44 joined by a traverse 43 and swingable as indicated by arrow 45. This traverse 43 can therefore be swung in and engaged in the mouth 18 of the bracket 8 immediately above the platform 5 to allow the cable 41 to be unhooked from the bracket further up and to be slung over the bracket immediately above the platform 5 so that this higher bracket can be removed and the wall can be sheathed over at this level.

Thus with the system of this invention everything but the sheathing 61 is put in place at about the same time, that is story by story, as the building goes up. Once complete the platform 5 moves back down and serves as a safe and solid mount for the workers who install the sheathing 61 and pull out the removable and reusable brackets 8. The sockets 9 are abandoned in the wall, but these elements are very inexpensive and might even come in handy at a later date if the building needs major exterior repair.

It is also possible to attach the sheathing as the platform 5 goes up by suspending light scaffolding beneath the platform 5 and working from this level to apply the sheathing to the story below the one the platform is working on. Thus at one time the platform can be hanging at one floor while the studs 3 and insulation 12 are being set up for the overlying floor and the sheathing is being applied to the underlying floor.

FIGS. 7 and 8 show another simpler socket 9' constituted as a simple U-shaped plate 27 bridged by the nail tab 27. This socket 9' is extremely inexpensive to manufacture so that abandoning it in the wall represents no meaningful cost, and will be anchored extremely well due to the two tabs formed by the channel legs.

Figure 12:
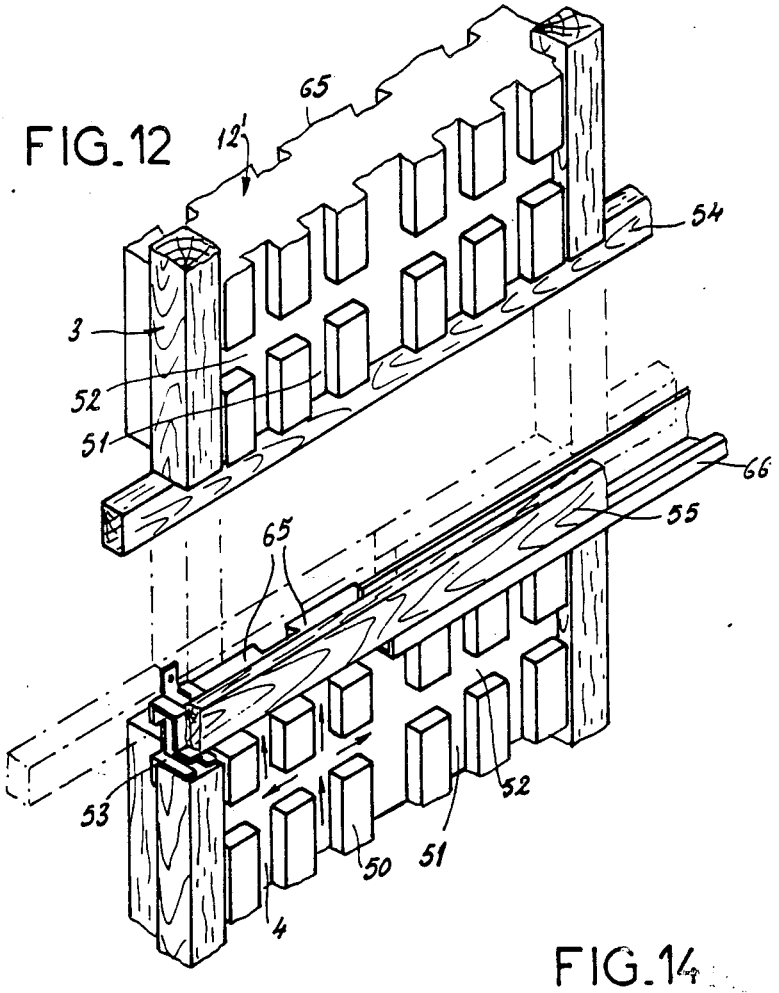
FIG. 12 is a partly exploded perspective view of a portion of another wall assembly according to this invention.
Figure 13:
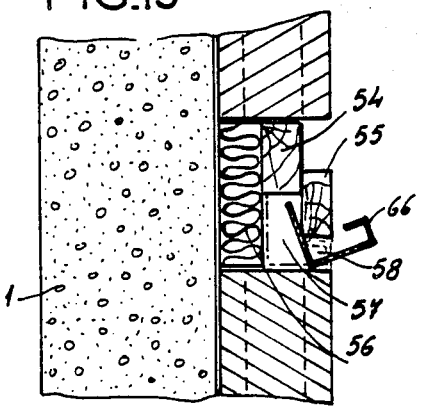
FIGS. 13 and 14 are vertical sections showing details of the wall assembly of FIG. 12 at two different stages of construction.
Figure 14:
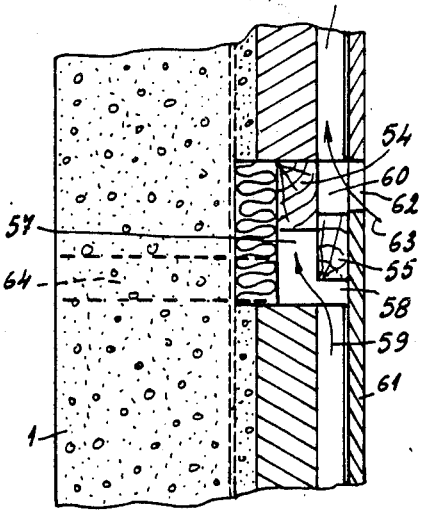

In FIGS. 12 through 14 insulation panels 12' are used having dovetail-shaped vertical ridges 65 on their inside surface and parallelepipedal bumps 50 forming vertical grooves 51 and horizontal grooves 52 on the outside surface. The ridges 65 insure a good connection to the wall 1 poured against the inner faces of the panels 12'. These panels 12' are prefabricated with the studs 3 which are all of the same length, and with horizontal frame members 54 set centrally along their lower edges and further horizontal frame members 55 set flush with the outside surface along their upper edges. Stainless-steel clips 53 function to vertically space adjacent such prefabricated panels which fit together so that each upper stud 55 vertically overlaps and bears inward against the lower stud 54 of the overlying panel. The result is to form at the top of each panel a horizontal chamber 57 into which all of the channels 51 of the panel empty via a connecting passage 58, and to form at the bottom of each panel a passage 60 into which all of the channels 51 of the panel open downward.

During pouring of the wall 1 blocking clips 66 are fitted into the passages 57 to prevent the insulation from being pushed out at this level, and the wall 1 is formed with throughgoing holes 64 opening into these upper channels 57. Once the concrete of the wall 1 has cured, the clips 66 are removed.

This system has so-called parietodynamic action, that is it can breathe (See *Cahiers Techniques du Batiment* No. 76, Nov. 1985, page 72). The sheathing 61 is provided with holes 62 level with the chamber 60 so that air can enter as indicated by arrow 63 and rise up and in as indicated by arrow 59 in FIG. 14. This breathing action has many beneficial effects.

Figure 15:
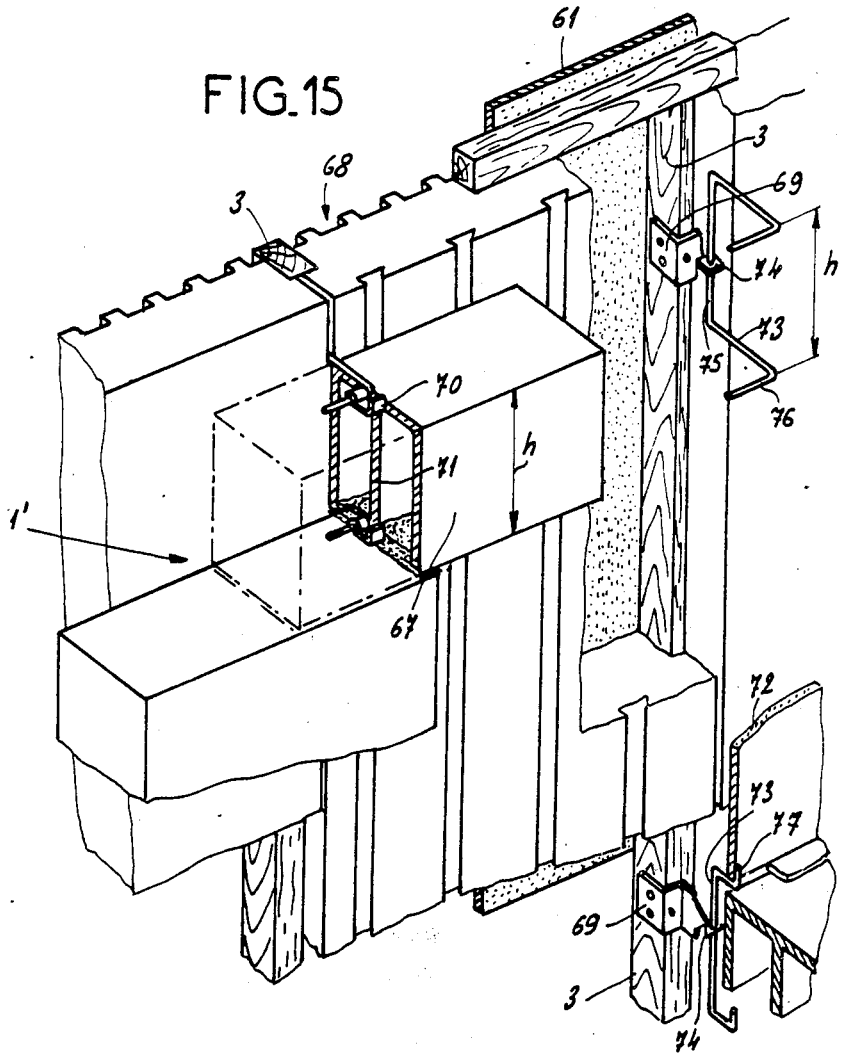
FIG. 15 is a partly sectional view of yet another wall system according to this invention.

The system of FIG. 15 is substantially identical to that of FIGS. 12 through 14, but instead of a poured wall 1 has a wall 1' formed of standard hollow concrete blocks 67 of a standard height h. In addition instead of the anchors 9, clips 69 are nailed to the studs 3 and carry eyes 74 in which U-shaped anchor wires 73 are slidable. These wires 73 have vertical bights 75 of a length equal to the block height h and so that the ends wire can engage in the mortar between the courses of block. The wires further have either inner ends 76 turned to the side and carrying spacer clips 70 of plastic that engage behind the central webs 71 of the block 67 or turned up ends 77 that similarly engage in the cores of the blocks behind the side walls 72 thereof.

This arrangement is used like those described above, except that the interior masonry wall 1' is built up of the blocks 67 rather than poured as a concrete, normally reinforced, structure. Insulation 68 between the studs 3 can be shaped like the insulation 12' of FIGS. 12 through 14. The vertical adjustability of the tie wires 73 makes it possible to adapt to the block placement after fixing of the mounting tabs 69 on the studs, without having to worry when nailing off these stud anchors. Clamps can be provided to lock the wires 73 in the eyes 74. These wires 73 also serve as spacers between the block wall and the outside insulating structure.

With the system of this invention is is therefore possible to substantially complete construction of the outside building walls in one operation, with most of the work being done from inside. Only the sheathing is applied from movable scaffolding outside the building, but since the studs to which this sheathing is attached are perfectly coplanar, such covering is a relatively simple task. The scaffolding moves up as the wall goes up and down as the sheathing goes on, eliminating the movement several times up and down the wall normally used in construction of a wall of multiple elements.

An unillustrated variant of the invention entails fixing the tab 69 from outside when the sheathing 61 is installed. It is mounted when the panels are prefabricated simply by being slipped between two insulation panels or is inserted at the job site if the insulation allows this to be done while still leaving some vertical adjustability. The tab can thus e displaced vertically as the interior masonry wall requires. Means 70 are therefore needed to engage against the inside surfaces of the blocks.

I claim:

1. A method of building a wall structure, the method comprising the steps of:

(a) erecting a framework of frame members against an outer brace panel;

(b) fitting insulation between the frame members and against the brace panel;

(c) fixing anchors to the insulation and framework with stems of the anchors projecting inward away from the panel past the insulation;

(d) thereafter building a masonry interior wall against the insulation with the stems of the anchors imbedded in the masonry wall;

(e) thereafter removing the outer brace panel; and (f) thereafter securing sheathing to the frame members.

2. The method defined in claim 1 wherein step (d) is carried out by forming the interior wall of blocks, the anchors having legs which themselves constitute the stems and which are imbedded in step (d) in the joints between the blocks.

3. The method defined in claim 1, further comprising the step before step (d) of (c') erecting an interior form spaced inward of the insulation, the wall of step (d) being formed by casting concrete between the interior form and the insulation.

4. The method defined in claim 1, further comprising the step before step (d) of (c') securing to the framework sockets having anchor stems projecting inward past the insulation, and before step (f) of (e') suspending a work platform from the sockets, step (f) being carried out from atop the work platform.

5. The method defined in claim 4, further comprising the step before step (e') of (d') hanging removable brackets from the sockets, the platform being suspended from the sockets in step (e') by hanging it on the brackets.

6. The method defined in claim 4 wherein step (f) is carried out in stages, the method further comprising the step of lowering the work platform between successive stages.

7. The method defined in claim 4, further comprising the step of supporting the brace panel in step (a) on the work platform.

8. The method defined in claim 4 wherein the framework is formed by vertical frame members and step (d) includes the step of mounting the sockets between vertically aligned such frame members.

9. The method defined in claim 4, wherein the sockets each comprise an anchor stem adapted to be imbedded in masonry;

a socket body having an open recess; and a mounting tab adapted to be secured to the framework, the method further comprising the step of mounting the sockets so that the recesses open upward.

10. The method defined in claim 9 wherein each bracket comprises a projecting tab, the method further comprising the step before step (e') of (d') hanging removable brackets from the sockets by fitting each tab in the recess of the respective socket body, the platform being suspended from the sockets in step (e') by hanging it on the brackets.

11. The method defined in claim 10 wherein each socket body is further formed below the upwardly open recess with an outwardly open recess, the method further comprising the step of fitting an inwardly projecting tab of each bracket in the outwardly open recess when the downwardly projecting tab is engaged in the respective upwardly open recess.

12. The method defined in claim 9, further comprising the step of using a jig for vertically spacing frame members for mounting therebetween of the sockets.

13. The method defined in claim 12, further comprising the steps of fitting a downwardly open recess of the jig over the upper end of a frame member and fitting into an upwardly open recess of the jig the lower end of another frame member with the two recesses of the jig being vertically offset and the jig being horizontally inwardly open therebetween for insertion of the respective socket.

14. The method defined in claim 9, further comprising the steps of attaching cables to the brackets to suspend the platform therefrom; and guiding the work platform on the cables by means of rigid rails engageable with the brackets.

15. The method defined in claim 9 wherein the insulation forms vertical passages and the framework includes horizontally offset upper and lower frame members, the method further comprising the step of positioning the upper and lower frame members of vertically adjacent panels such that same overlap.

16. The method defined in claim 15, further comprising the step of blocking the passages in the insulation for bracing same during building of the wall.

* * * * *